US009963951B2

(12) United States Patent
Arteaga et al.

(10) Patent No.: US 9,963,951 B2
(45) Date of Patent: May 8, 2018

(54) ANNULAR BLOWOUT PREVENTER

(71) Applicant: Cameron International Corporation, Houston, TX (US)

(72) Inventors: Nicolas J. Arteaga, Jersey Village, TX (US); Taylor R. Mozisek, Katy, TX (US); Miguel Urrutia, Rosharon, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 175 days.

(21) Appl. No.: 14/978,960

(22) Filed: Dec. 22, 2015

(65) Prior Publication Data

US 2017/0175477 A1 Jun. 22, 2017

(51) Int. Cl.
*E21B 33/06* (2006.01)

(52) U.S. Cl.
CPC ..... *E21B 33/06* (2013.01); *Y10T 137/5983* (2015.04)

(58) Field of Classification Search
CPC ..... E21B 33/06; Y10T 137/5983
USPC ..... 251/1.1, 1.2; 166/85.4, 84.4, 387
See application file for complete search history.

(56) References Cited

U.S. PATENT DOCUMENTS 2,609,836 A * 9/1952 Knox ..... E21B 33/06 251/1.2
3,225,831 A * 12/1965 Knox ..... E21B 33/047 166/97.5
4,460,150 A * 7/1984 Turlak ..... E21B 33/06 251/1.2
4,508,311 A * 4/1985 Just ..... E21B 33/06 251/1.2
4,579,314 A * 4/1986 Schaeper ..... E21B 33/06 251/1.2

OTHER PUBLICATIONS

Pressure Control Equipment, NOV Rig Systems, 2015, 87665015 Rev 01, National Oilwell Varco, Houston, TX, USA, 19 pages.
T-90 Annular BOP, Jul. 2013, AD00172DRL, Cameron, Houston, TX, USA, 2 pages.

* cited by examiner

*Primary Examiner* — Ian Paquette
(74) *Attorney, Agent, or Firm* — Helene Raybaud

(57) ABSTRACT

An annular blowout preventer includes a housing, an annular piston positioned within the housing, and an annular packer positioned within the housing. The annular blowout preventer also includes at least one radially-extending conduit disposed in the annular piston, the annular packer, or a plate positioned axially between the annular piston and the annular packer. The radially-extending conduit is configured to enable a fluid to flow from a central bore to an annular space between the annular packer and the housing when the annular blowout preventer is in a closed position.

20 Claims, 7 Drawing Sheets

ANNULAR BLOWOUT PREVENTER

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

An annular blowout preventer (BOP) is installed on a wellhead to seal and control an oil and gas well during drilling operations. A drill string may be suspended inside an oil and gas well from a rig through the annular BOP into the well bore. During drilling operations, a drilling fluid is delivered through the drill string and returned up through an annulus between the drill string and a casing that lines the well bore. In the event of a rapid invasion of formation fluid in the annulus, commonly known as a "kick," the annular BOP may be actuated to seal the annulus and to control fluid pressure in the wellbore, thereby protecting well equipment disposed above the annular BOP. The construction of the annular BOP can affect the ability of the annular BOP to effectively seal the annulus. Therefore, it would be desirable to improve the construction of the annular BOP.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to annular blowout preventers (BOPs). Annular BOPs include a piston (e.g., an annular piston) and a packer (e.g., an annular packer) disposed within a housing (e.g., an annular housing). The piston may be adjusted in a first direction to drive the packer from an open position to a closed position to seal an annulus around a drill string disposed through a central bore of the annular BOP or to close the central bore. In certain annular BOPs, a large amount of pressure may be applied to the piston to drive the packer into the closed position and/or to maintain the seal over time. The large amount of pressure may be unacceptable to well operators or may be difficult to implement using existing equipment. Thus, it would be desirable for the annular BOP to have a configuration that enables the packer to achieve the closed position and/or to maintain the seal with a lower pressure applied to the piston. Accordingly, the disclosed embodiments include annular BOPs configured to enable a fluid to flow from the central bore of the annular BOP to a space (e.g., annular space) between the packer and the housing of the annular BOP. By directing the fluid to the space, a downward force (e.g., reaction force) exerted by the packer on the piston while the annular BOP is in the closed position may be reduced, thereby enabling the packer to achieve the closed position and/or to maintain the seal with a lower pressure applied to the piston.

Figure 1:
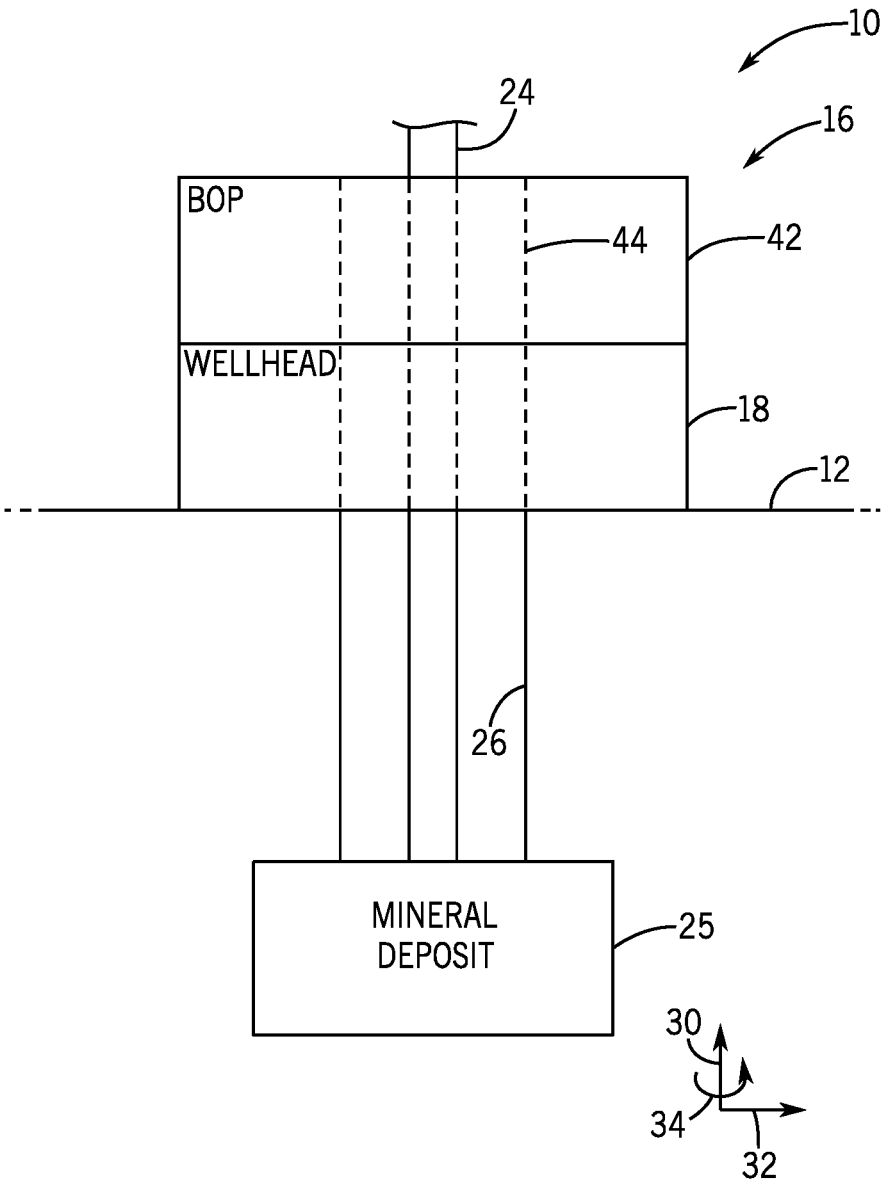
FIG. 1 is a block diagram of a mineral extraction system in accordance with an embodiment of the present disclosure.

With the foregoing in mind, FIG. 1 is a block diagram of an embodiment of mineral extraction system 10. The illustrated mineral extraction system 10 may be configured to extract various minerals and natural resources, including hydrocarbons (e.g., oil and/or natural gas), from the earth, or to inject substances into the earth. The mineral extraction system 10 may be a land-based system (e.g., a surface system) or an offshore system (e.g., an offshore platform system). A BOP assembly 16 (e.g., BOP stack) is mounted to a wellhead 18, which is coupled to a mineral deposit via a wellbore 26. The wellhead 18 may include any of a variety of other components such as a spool, a hanger, and a "Christmas" tree. The wellhead 18 may return drilling fluid or mud to the surface 12 during drilling operations, for example. Downhole operations are carried out by a tubular string 24 (e.g., drill string, production tubing string, or the like) that extends, through the BOP assembly 16, through the wellhead 18, and into the wellbore 26.

To facilitate discussion, the BOP assembly 16 and its components may be described with reference to an axial axis or direction 30, a radial axis or direction 32, and a circumferential axis or direction 34. The BOP assembly 16 may include one or more annular BOPs 42 and/or one or more ram BOPs (e.g., shear ram, blind ram, blind shear ram, pipe ram, etc.). A central bore 44 (e.g., flow bore) extends through the one or more annular BOPs 42. As discussed in more detail below, each of the annular BOPs 42 includes a packer (e.g., annular packer) that is configured to be mechanically squeezed radially inward to seal about the tubular string 24 extending through the central bore 44 (e.g., to block an annulus about the tubular string 24) or to block flow through the central bore 44. The disclosed embodiments include annular BOPs 42 having various features, such as grooves (e.g., radially-extending grooves) formed in a surface of the packer, that reduce the operating pressure needed to achieve and/or to maintain a closed position in which the packer seals about the tubular string 24 or blocks flow through the central bore 44.

Figure 2:
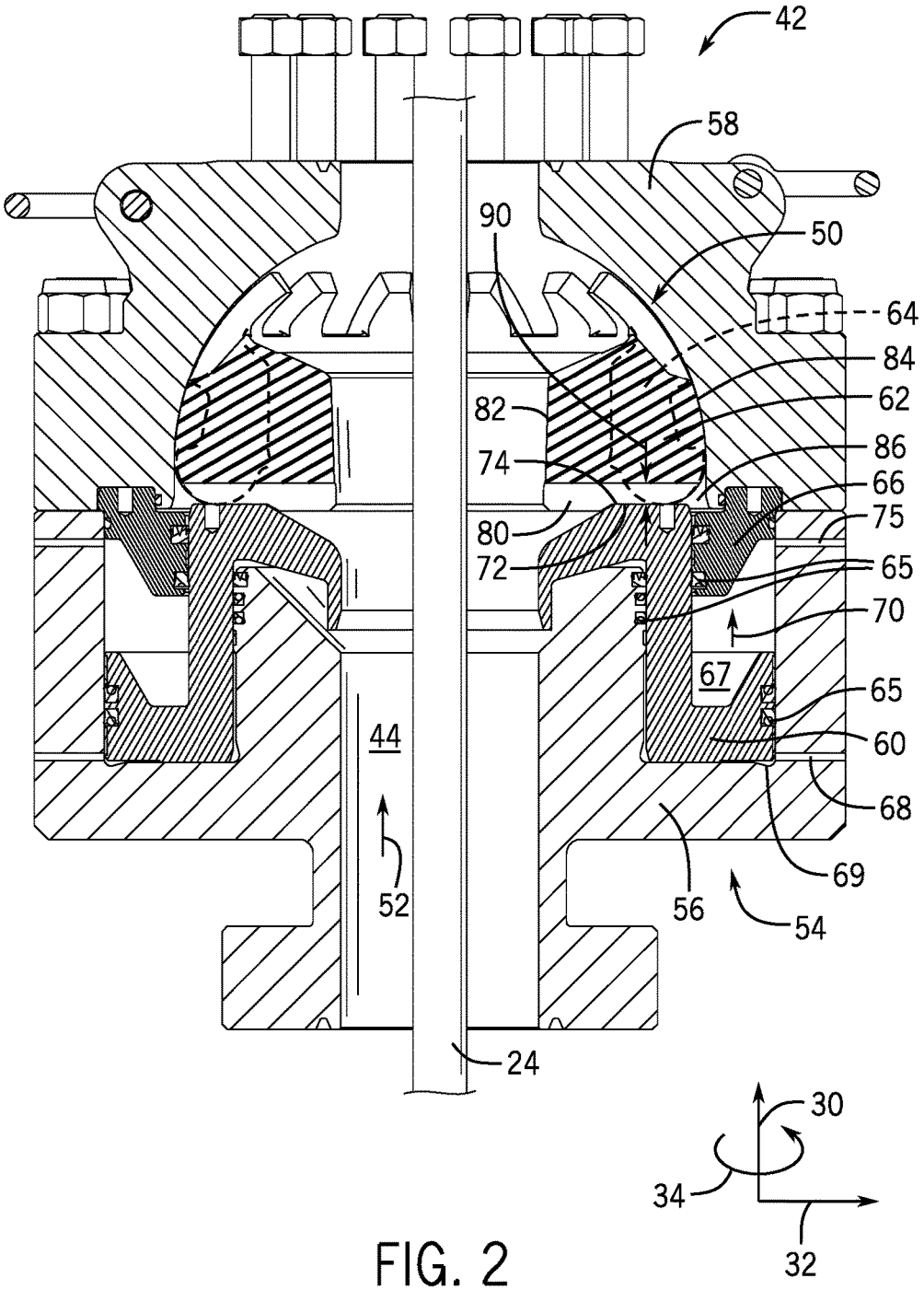
FIG. 2 is a cross-sectional side view of an embodiment of an annular BOP that may be used in the system of FIG. 1, wherein the annular BOP is in an open position.

FIG. 2 is a cross-sectional side view of the annular BOP 42 that may be used in the system 10 of FIG. 1. In the illustrated embodiment, the annular BOP 42 is in an open position 50. In the open position 50, fluid may flow through the central bore 44 of the annular BOP 42, as shown by arrow 52. The annular BOP 42 includes a housing 54 having a body 56 and a top 58 (e.g., top portion or top component) coupled to the body 56. A piston 60 (e.g., annular piston) and a packer 62 (e.g., annular packer) are positioned within the housing 54. The packer 62 is a flexible component (e.g., elastomer) with rigid inserts 64 (e.g., metal inserts or reinforcing inserts) positioned at discrete circumferential locations about the packer 62. An adapter 66 (e.g., annular adapter) is positioned between the body 56 and the top 58. Various seals 65 (e.g., annular seals) may be provided in the body 56, the piston 60, and/or the adapter 66 to seal gaps 67, 69 (e.g., annular gaps) from the central bore 44 and from one another.

As discussed in more detail below, the piston 60 is configured to move relative to the housing 54 in the axial direction 30. For example, a fluid (e.g., a liquid and/or gas from the one or more fluid conduits 28) may be provided to the gap 69 via a first fluid conduit 68 to drive the piston 60 upward in the axial direction 30, as shown by arrow 70. As the piston 60 moves upward, the piston 60 drives the packer 62 upward. For example, an axially-facing surface 72 (e.g., e.g., packer-contacting surface, top surface, upper surface, or annular surface) of the piston 60 may apply an upward force against an axially-facing surface 74 (e.g., piston-contacting surface, bottom surface, lower surface, or annular surface) of the packer 62, driving the packer upward. When driven upward by the piston 60, the packer 62 may move upward and inward within the top 58 to a closed position in which the packer 62 seals around the tubular string 24 extending through the central bore 44 or closes off the central bore 44. A second fluid conduit 75 is configured to provide a fluid (e.g., a liquid and/or gas) to the gap 67 to drive the piston 60 downward, thereby causing the packer 62 to move into the open position 50.

In the illustrated embodiment, the packer 62 includes one or more grooves 80 (e.g., radially-extending grooves, troughs, channels, slots, or the like). The grooves 80 may have any suitable configuration to enable a fluid to flow from the central bore 44 to a space 86 (e.g., annular space) between the housing 54 and the packer 62. For example, while the grooves 80 are illustrated, it should be understood that the packer 62 may additionally or alternatively include other types of conduits (e.g., passageways having an outer wall surrounded by the packer 62) extending radially through the packer 62 to enable fluid to flow from the central bore 44 to the space 86. As shown, the grooves 80 are formed in the axially-facing surface 74 of the packer 62 and extend from an inner surface 82 (e.g., radially inner surface) to an outer surface 84 (e.g., radially outer surface) of the packer 62. The grooves 80 may be formed at discrete locations about the packer 62 (e.g., discrete locations that are spaced apart circumferentially about the packer 62). In some embodiments, the grooves are formed at discrete locations between adjacent rigid inserts 64. In the illustrated embodiment, the grooves 80 are open toward the piston 60 such that the piston 60 and the packer 62 are separated from one another by an axial distance 90 along the grooves 80. Thus, at some circumferential locations, the piston 60 and the packer 62 contact one another, and at other circumferential locations coincident with the grooves 80, the piston 60 and the packer 62 are axially spaced apart from one another. As discussed in more detail below, such a configuration facilitates transfer of a fluid from the central bore 44 along the grooves 80 to the space 86, which enables the use of reduced operating pressures (e.g., applied via the fluid conduit 68) to effectively close the annular BOP 42.

Figure 3:
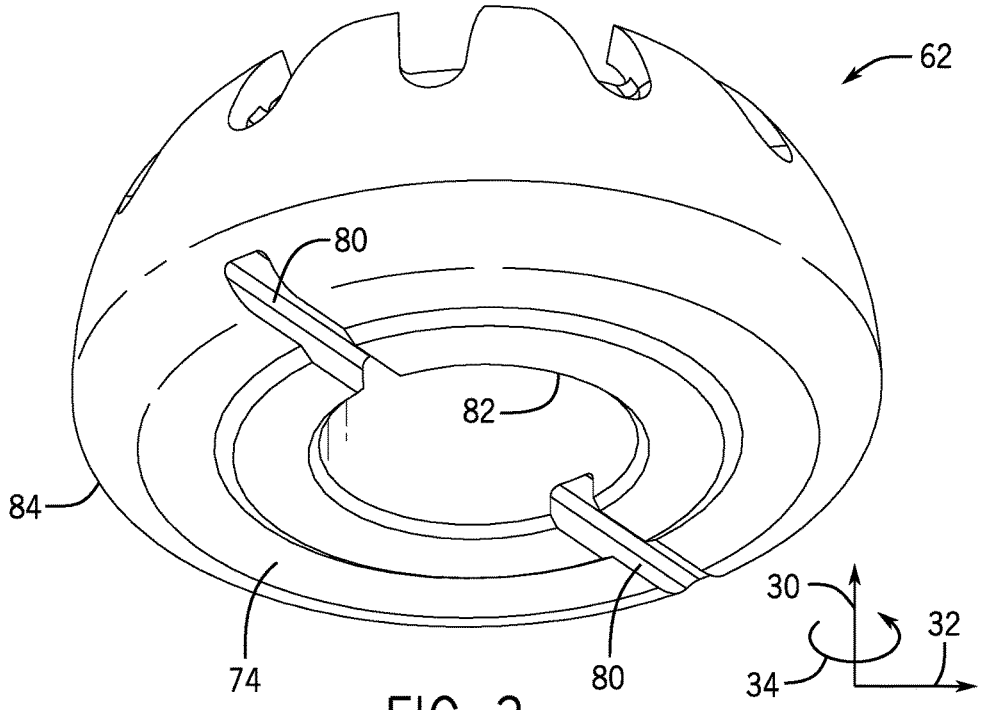
FIG. 3 is a perspective bottom view of an embodiment of an annular packer that may be used in the annular BOP of FIG. 2.

FIG. 3 is a perspective bottom view of an embodiment of the packer 62. As shown, the packer 62 includes grooves 80 formed in the axially-facing surface 74 of the packer 62, and the grooves 80 extend radially from the inner surface 82 to the outer surface 84 of the packer 62. In the illustrated embodiment, the packer 62 includes two grooves 80 positioned on opposite sides (e.g., at 180 degrees from one another) of the packer 62. However, any suitable number of grooves 80 may be provided. For example, 1, 2, 3, 4, 5, 6, 7, 8, 9, 10, or more grooves 80 may be distributed with a non-uniform or uniform circumferential spacing about the packer 62.

Figure 4:
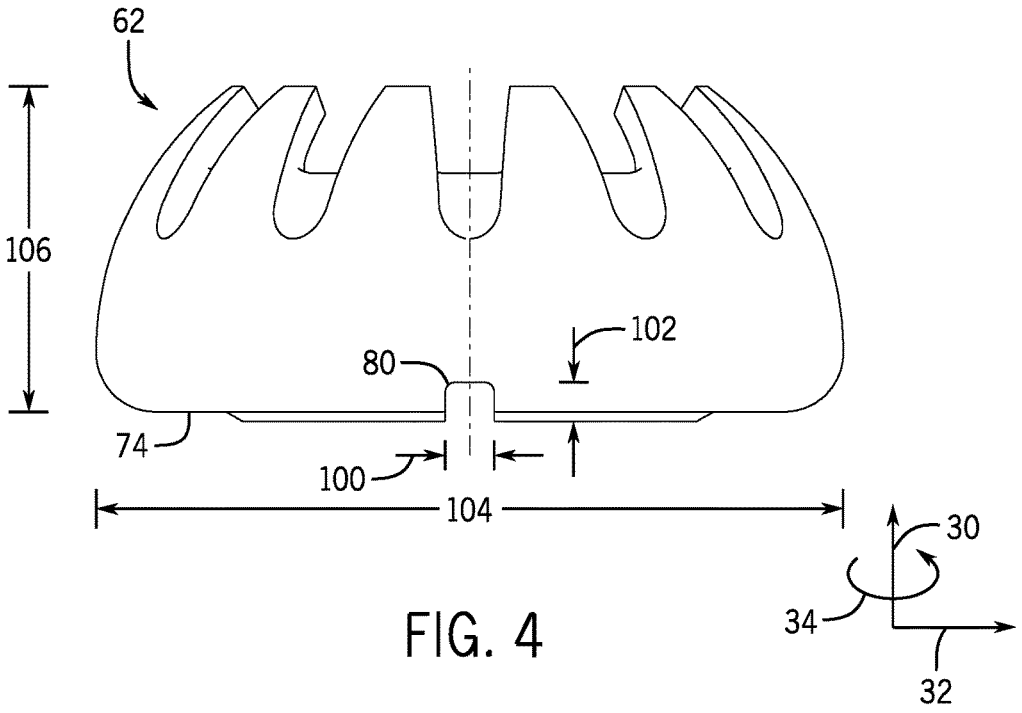
FIG. 4 is a side view of an embodiment of an annular packer that may be used in the annular BOP of FIG. 2.

FIG. 4 is a side view of an embodiment of the packer 62. As shown, the grooves 80 are formed in the axially-facing surface 74 of the packer 62. The grooves 80 have generally rectangular cross-section extending in the radial direction 32, although the grooves 80 may have any suitable cross-section, including a curved cross-section (e.g., a u-shaped or semi-circular cross-section). The grooves 80 may have any suitable dimensions that enable the grooves 80 to transfer the fluid from the central bore 44 toward the outer surface 84 of the packer 62 and/or to the space 86 while the annular BOP 42 is in the open position 50 and/or in a closed position (e.g., while the packer 62 seals around the tubular string 24 or closes the central bore 44). For example, the grooves 80 may have a width 100 of approximately 1.5, 2, 2.5, 3, 3.5, 4, 4.5, or 5 centimeters (cm) and/or a height 102 of approximately 1.5, 2, 2.5, 3, 3.5, 4, 4.5, or 5 cm. In some embodiments, the width 100 may be at least 1.5, 2, 2.5, 3, 3.5, 4, 4.5, or 5 centimeters (cm) and/or the height 102 may be at least 1.5, 2, 2.5, 3, 3.5, 4, 4.5, or 5 cm. In some embodiments, the width 100 may be between approximately 1.5 to 5, 2 to 4.5, 2.5 to 3.5, or 3 to 3.25 cm and/or the height 102 may be between approximately 1.5 to 5, 2 to 4.5, 2.5 to 3.5 cm, or 2.25 to 2.75 cm. In certain embodiments, the width 100 may be approximately 3, 4, 5, 6, 7, 8, 9 or 10 percent of a packer width 104 and/or the height 102 may be approximately 5, 6, 7, 8, 9, 10, 11, 12, 13, 14, or 15 percent of a packer height 106. In certain embodiments, the width 100 may be at least 3, 4, 5, 6, 7, 8, 9 or 10 percent of the packer width 104 and/or the height 102 may be at least 6, 7, 8, 9, 10, 11, 12, 13, 14, or 15 percent of the packer height 106. In certain embodiments, the width 100 may be between approximately 3 to 10, 4 to 9, 5 to 8, or 6 to 7 percent of the packer width 104 and/or the height 102 may be between approximately 5 to 15, 6 to 14, 7 to 13, 8 to 12, or 9 to 11 percent of the packer height 106.

Figure 5:
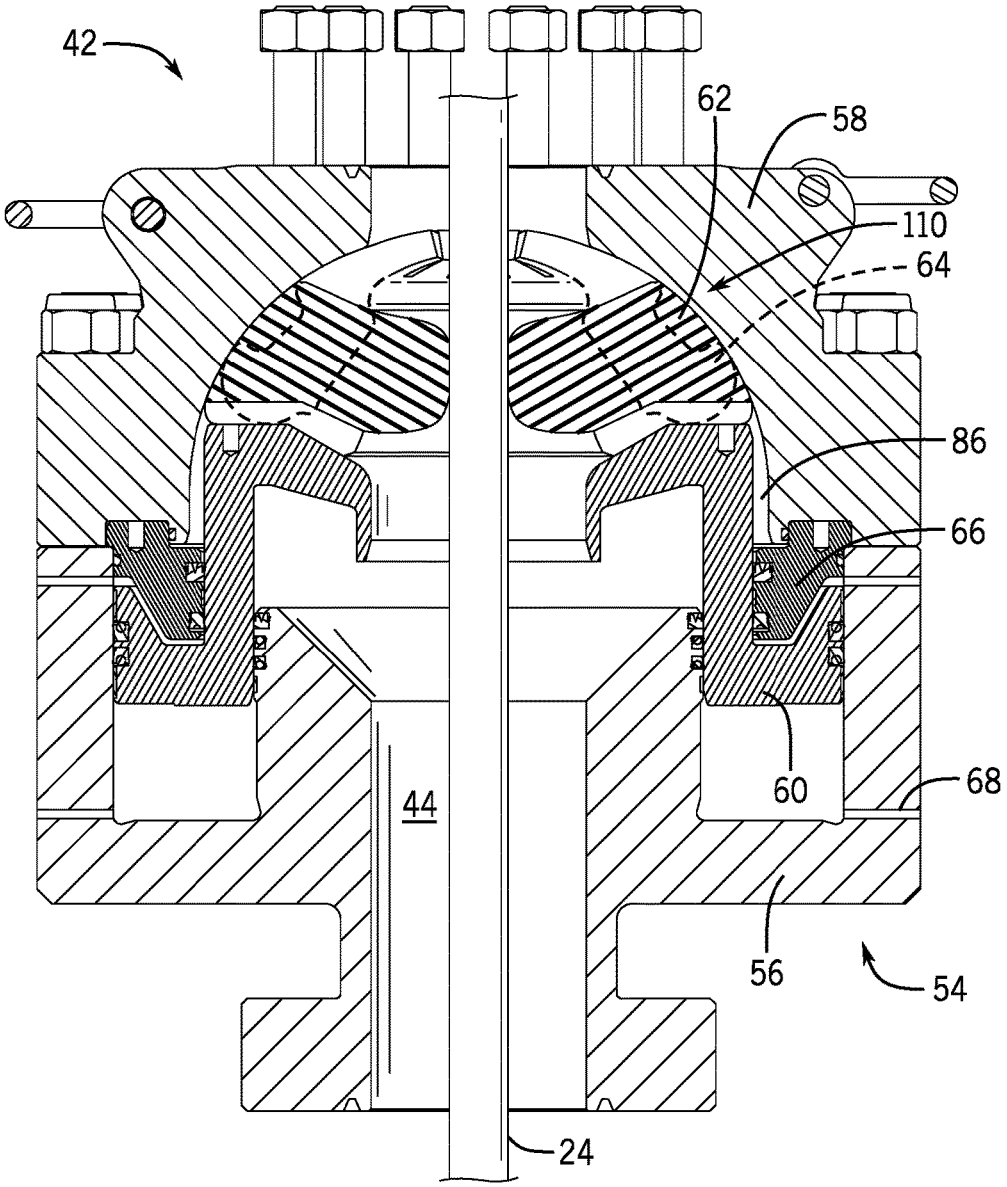
FIG. 5 is a cross-sectional side view of the annular BOP of FIG. 2 in a closed position, in accordance with an embodiment of the present disclosure.

FIG. 5 is a cross-sectional side view of the annular BOP 42 in a closed position 110, in accordance with an embodiment of the present disclosure. In the closed position 110, the packer 62 seals about the tubular string 24 extending through the central bore 44 or closes the central bore 44, thereby blocking fluid from flowing through the central bore 44 and above the packer 62. As discussed above, the piston 60 moves in the axial direction 30 upon application of fluid from the fluid conduit 68, thereby driving the packer 62 in the axial direction 30. As the packer 62 moves in the axial direction 30, the piston 60 and the top 58 squeeze the flexible material of the packer 62 inward and upward to seal about the tubular string 24 or to close the central bore 44.

In the illustrated embodiment, the grooves 80 enable fluid from the central bore 44 to flow toward the outer surface 84 of the packer 62 and/or to the space 86 between the packer 62 and the housing 54 while the annular BOP 42 is in the closed position 110. Such a configuration enables the annular BOP 42 to achieve and/or to maintain the closed position 110 using a relatively low operating pressure (e.g., closing pressure or pressure applied to the piston 60 via the fluid conduit 68). For example, an operating pressure of approximately 1500 pounds per square inch (psi) may be sufficient to close the annular BOP 42 and to hold or to support approximately 5000 psi wellbore pressure (e.g., working pressure). However, without the disclosed grooves 80, a seal (e.g., an annular seal or a complete annular seal) may form between the packer 62 and the piston 60. In such cases, the wellbore pressure exerts an upward force on a radially-inner portion of the packer 62 located between the seal and the tubular string 24 (e.g., the radially-inner portion of the packer 62 adjacent to the tubular string 24), and due to various features of the annular BOP 42 (e.g., characteristics of the packer 62, such as material, shape, position, etc.), a radially-outer portion of the packer 62 (e.g., the radially-outer portion of the packer 62 between the seal and a radially-outer surface of the packer 62) exerts a downward force on the piston 65. Thus, in such cases, a relatively higher operating pressure of approximately 1800 psi or more may be used to drive the piston 65 upward to close a typical annular BOP of the same size (e.g., to counter the downward force on the piston 65 from the radially-outer portion of the packer 62).

With the grooves 80, the complete annular seal is not formed at an interface between the packer 62 and the piston 65, and the wellbore pressure exerts an upward force on the packer 62 across a radius (e.g., a complete radius) of the packer 62 (i.e., not only on a radially-inner portion) enabling use of relatively lower operating pressures. The grooves 80 facilitate transfer of fluid from the central bore 44 under the packer 62 (e.g., along the grooves 80) and/or to the space 86 bounded at least in part by the outer surface 84 of the packer 62. This transfer of fluid may assist in sealing the packer 62 about the tubular string 24 and/or closing off the central bore 44 by urging the packer 62 upward and/or by reducing a downward force (e.g., reaction force) exerted by the packer 62 on the piston 60. As noted above, while the packer 62 illustrated in FIGS. 2-5 includes grooves 80, it should be understood that the packer 62 may additionally or alternatively include other types of conduits (e.g., passageways having an outer wall surrounded by the packer 62) extending radially through the packer 62 to enable fluid to flow from the central bore 44 to the space 86.

Figure 6:
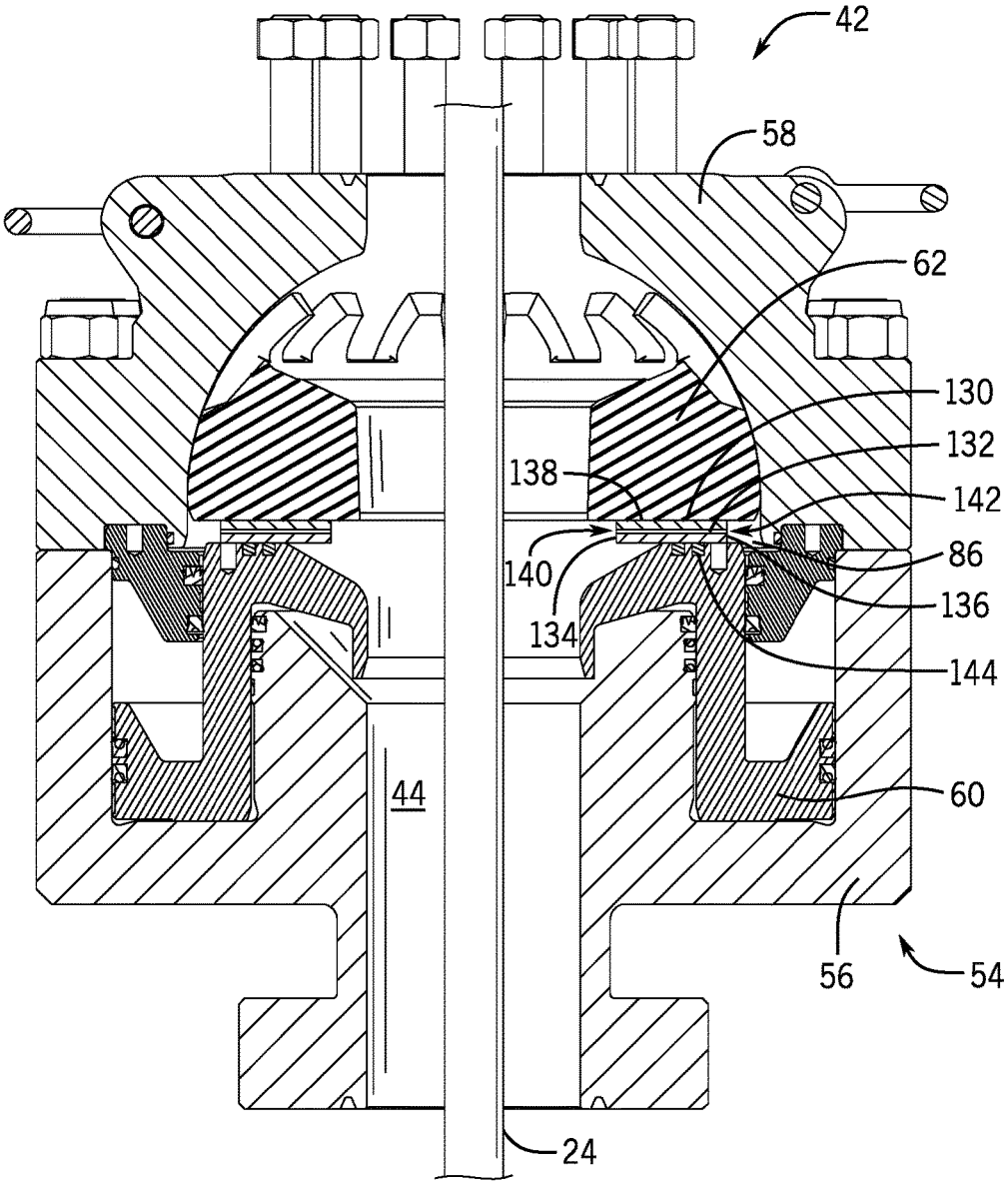
FIG. 6 is a cross-sectional side view of an embodiment of an annular BOP that may be used in the system of FIG. 1, wherein the annular BOP is in an open position and a plate having a passageway is positioned between an annular packer and a piston of the annular BOP.

FIG. 6 is a cross-sectional side view of an embodiment of the annular BOP 42 having a plate 130 (e.g., annular plate) positioned axially between the packer 62 and the piston 60. In the illustrated embodiment, the plate 130 has passageways 132 each extending radially through the plate 130 from an inner surface 134 (e.g., radially inner surface) to an outer surface 136 (e.g., radially outer surface) of the plate 130. Thus, each passageway 132 has a first opening 140 in the inner surface 134 and a second opening 142 in the outer surface 136. In the illustrated embodiment, each passageway 132 has an outer wall 138 that is surrounded by or contacted by the plate 130. The passageways 132 may be provided at discrete circumferential locations about the plate 130. Additionally, any suitable number of passageways 132 (e.g., 1, 2, 3, 4, 5, 6, 7, 8, 9, 10, or more) may be provided with uniform or non-uniform circumferential spacing.

As shown, the plate 130 is coupled to the axially-facing surface 72 of the piston 60 via fasteners 144 (e.g., threaded fasteners). Additionally or alternatively, in some embodiments, the plate 130 may be coupled to the axially-facing surface 74 of the packer 62 via fasteners (e.g., threaded fasteners). Although fasteners 144 are illustrated, the plate 130 may additionally or alternatively be coupled to the piston 60 and/or the packer 62 via any suitable coupling, including a welded connection, an adhesive, key-fit interface (e.g., corresponding recess and key), or the like. In certain embodiments, the plate 130 may not be coupled to the piston 60 and/or the packer 62, but may be supported (e.g., held in position relative to the piston 60) between the piston 60 and the packer 62 due to a shape and/or an incline of an interface between the plate 130, the piston 60, and/or the packer 62. For example, the axially-facing surface 72 of the piston 60 may be inclined along the axial axis between a radially inner edge and a radially-outer edge, thereby maintaining the illustrated position of the plate 130 relative to the piston 60. The plate 130 and/or the passageways 132 may have any suitable shape and/or size to facilitate the flow of fluid from the central bore 44 toward the outer surface 84 of the packer 62 and/or to the space 86 between the packer 62 and the housing 54 while the annular BOP 42 is in the closed position 110. For example, while the plate 130 illustrated in FIG. 6 includes the passageways 132, it should be understood that the plate 130 may additionally or alternatively include other types of conduits (e.g., radially-extending grooves open toward the packer 62 or the piston 60). The plate 130 may be formed from any suitable material, such as a polymer, elastomer, metal, or metal alloy. In a manner similar to that discussed above with respect to FIGS. 2-5, the transfer of fluid from the central bore 44 through the passageways 132 may enable the annular BOP 42 to achieve and/or to maintain the closed position 110 using a relatively low operating pressure.

Figure 7:
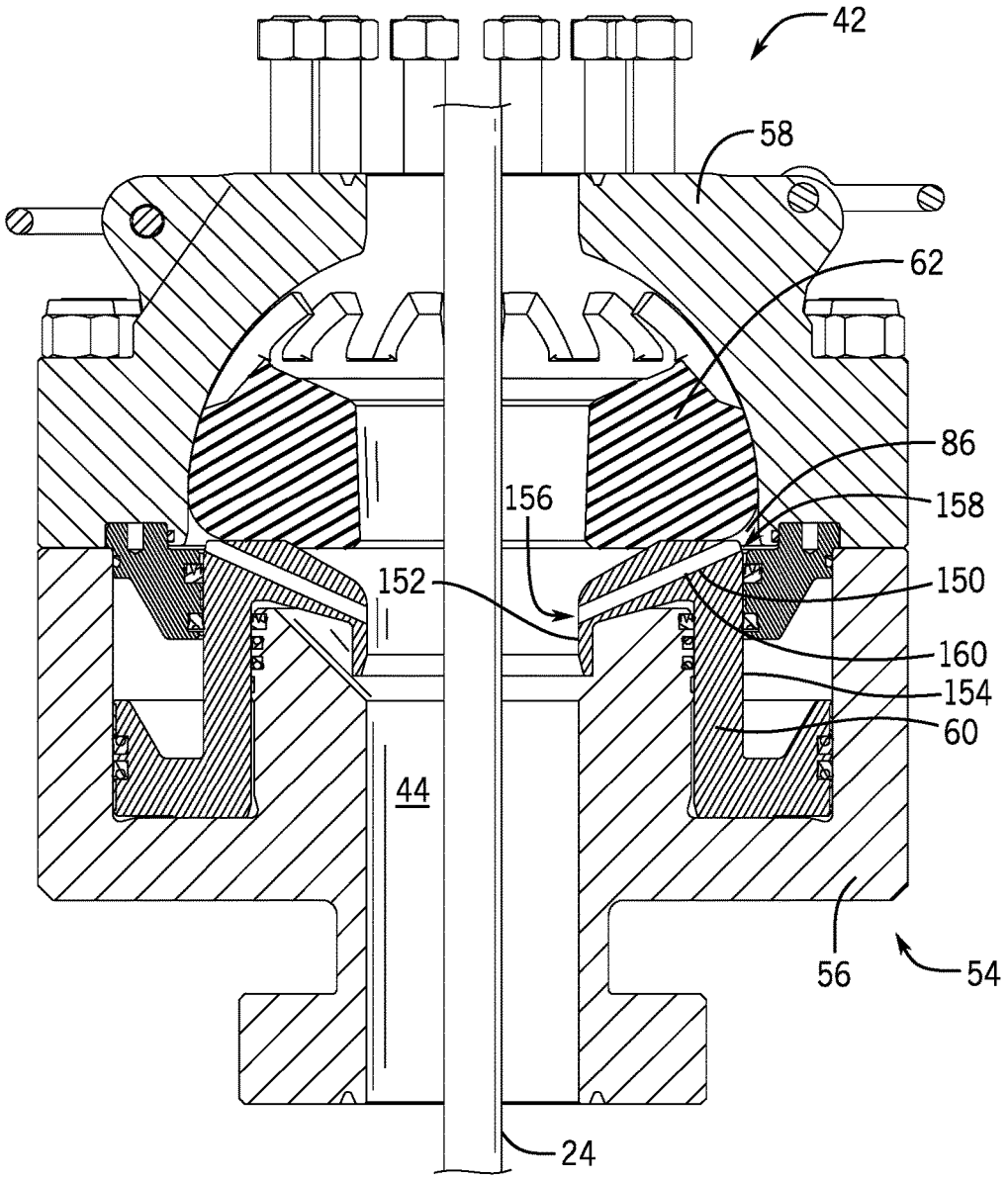
FIG. 7 is a cross-sectional side view of an embodiment of an annular BOP that may be used in the system of FIG. 1, wherein the annular BOP is in an open position and a passageway is provided through a piston of the annular BOP.

FIG. 7 is a cross-sectional side view of an embodiment the annular BOP 42 having passageways 150 extending through the piston 60. In the illustrated embodiment, each passageway 150 extends radially through the piston 60 from an inner surface 152 (e.g., radially inner surface) toward an outer surface 154 (e.g., radially outer surface) and/or the axially-facing surface 72 of the piston 60. Thus, each passageway 150 has a first opening 156 in the inner surface 152 and a second opening 158 in the outer surface 154 and/or in the axially-facing surface 72. In the illustrated embodiment, each passageway 150 has an outer wall 160 that is surrounded by or contacted by the piston 60. The passageways 150 may be provided at discrete circumferential locations about the piston 60. Additionally, any suitable number of passageways 150 (e.g., 1, 2, 3, 4, 5, 6, 7, 8, 9, 10, or more) may be provided with uniform or non-uniform circumferential spacing. The passageways 150 may have any suitable shape and/or size to facilitate the flow of fluid from the central bore 44 toward the outer surface 84 of the packer 62 and/or to the space 86 between the packer 62 and the housing 54 while the annular BOP 42 is in the closed position 110. For example, while the piston 60 illustrated in FIG. 7 includes the passageways 150, it should be understood that the piston 60 may additionally or alternatively include other types of conduits (e.g., radially-extending grooves open toward the packer 62). In a manner similar to that discussed above with respect to FIGS. 2-6, the transfer of fluid from the central bore 44 through the passageways 150 may enable the annular BOP 42 to achieve and/or to maintain the closed position 110 using a relatively low operating pressure.

Figure 8:
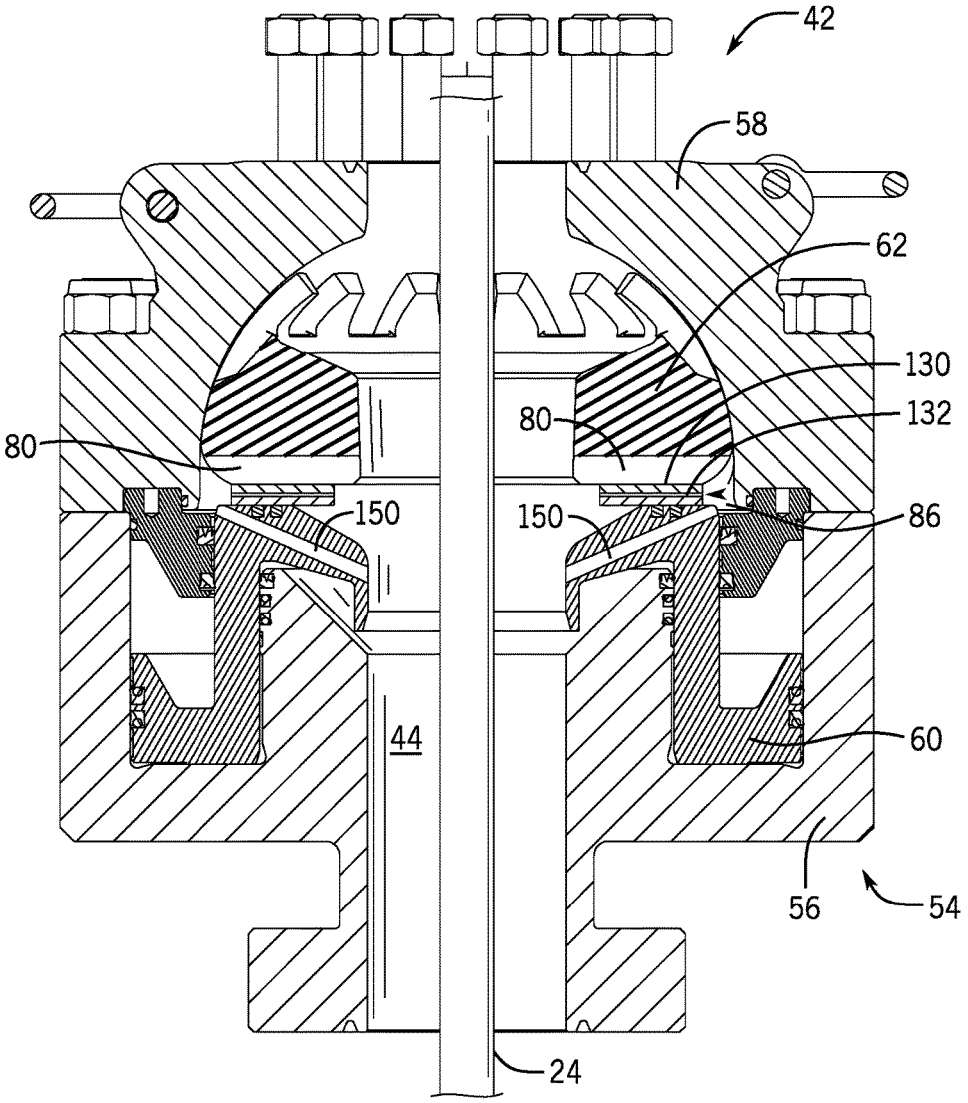
FIG. 8 is a cross-sectional side view of an embodiment of an annular BOP that may be used in the system of FIG. 1, wherein the annular BOP is in an open position and includes multiple conduits configured to enable fluid to flow from a central bore to an annular space.

Any of the features disclosed above may be combined or used together in any of a variety of manners. For example, FIG. 8 is a cross-sectional side view of an embodiment of the annular BOP 42 having multiple conduits configured to enable a flow of fluid from the central bore 44 to the space 86. In the illustrated embodiment, the annular BOP 42 includes the grooves 80 formed in the axially-facing surface 74 of the packer 62, the plate 130 positioned axially between the packer 62 and the piston 60 and having passageways 132, and the passageways 150 extending through the piston 60.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An annular blowout preventer, comprising:
a housing;
an annular piston positioned within the housing;
an annular packer positioned within the housing; and
at least one radially-extending conduit disposed in the annular packer, wherein the radially-extending conduit is configured to enable a fluid to flow from a central bore to an annular space between the annular packer and the housing when the annular blowout preventer is in a closed position.

2. The annular blowout preventer of claim 1, wherein the at least one radially-extending conduit comprises a groove disposed in an axially-facing surface of the annular packer.

3. The annular blowout preventer of claim 1, wherein the at least one radially-extending conduit comprises two grooves disposed in an axially-facing surface of the annular packer, wherein the two grooves are circumferentially spaced apart 180 degrees from one another.

4. The annular blowout preventer of claim 1, wherein the at least one radially-extending conduit comprises a width and a height, and the width and the height are between 1.5 and 5 centimeters.

5. The annular blowout preventer of claim 1, wherein the at least one radially-extending conduit comprises a width and a height, the annular packer comprises a packer width and a packer height, the width is between approximately 3 to 10 percent of the packer width, and the height is between approximately 5 to 15 percent of the packer height.

6. The annular blowout preventer of claim 1, wherein the annular packer comprises rigid inserts spaced circumferentially about the annular packer, and the at least one radially-extending conduit is disposed in a flexible material of the annular packer between adjacent rigid inserts.

7. The annular blowout preventer of claim 1, comprising at least one passageway extending through the annular piston or through an annular plate positioned between the annular packer and the annular piston, wherein the at least one passageway is configured to enable the fluid to flow from the central bore to the annular space when the annular blowout preventer is in the closed position.

8. The annular blowout preventer of claim 1, wherein the at least one radially-extending conduit comprises only two grooves disposed in an axially-facing surface of the flexible material of the annular packer.

9. The annular blowout preventer of claim 1, wherein the at least one radially-extending conduit is configured to block formation of a complete annular seal between a flexible material of the annular packer and the annular piston when the annular blowout preventer is in the closed position.

10. The annular blowout preventer of claim 1, wherein the annular piston is configured to move in an axial direction to adjust the annular blowout preventer from an open position to the closed position, and the fluid within the annular space drives the annular packer in the axial direction to maintain the annular blowout preventer in the closed position.

11. A system, comprising:
an annular blowout preventer, comprising:
an annular piston configured to move in an axial direction within a housing, wherein the annular piston comprises an upper axially-facing surface that extends in a plane that is perpendicular to the axial direction;
an annular packer having a lower axially-facing surface configured to contact the upper axially-facing surface of the annular piston; and
one or more radially-extending conduits formed in the annular piston or the annular packer, wherein the one or more radially-extending conduits enable a fluid to flow between the upper axially-facing surface of the annular piston and the lower axially-facing surface of the annular packer.

12. The system of claim 11, wherein the one or more radially-extending conduits comprise a groove formed in the lower axially-facing surface of the annular packer.

13. The system of claim 11, wherein the one or more radially-extending conduits comprise two grooves formed in the lower axially-facing surface of the annular packer, wherein the two grooves are circumferentially spaced apart 180 degrees from one another.

14. The system of claim 11, wherein the one or more radially-extending conduits comprise a width and a height, and the width and the height are between 1.5 and 5 centimeters.

15. The system of claim 11, wherein the annular packer comprises rigid inserts spaced circumferentially about the annular packer, and the one or more radially-extending conduits are disposed in the annular packer between adjacent rigid inserts.

16. The system of claim 11, wherein the one or more radially-extending conduits comprise a passageway extending through the annular piston or a groove formed in the upper axially-facing surface of the annular piston.

17. A system, comprising:
an annular blowout preventer configured to move between an open position that enables a fluid flow across a central bore of the annular blowout preventer and a closed position that blocks the fluid flow across the central bore, comprising:
a housing;
an annular packer positioned within the housing;
an annular piston positioned within the housing and configured to move in an axial direction to adjust the annular packer to cause the annular blowout preventer to move from the open position to the closed position;

and one or more radial conduits positioned at discrete circumferential locations and extending through the annular packer, wherein the one or more radial conduits enable the fluid flow to travel from the central bore of the annular blowout preventer to an annular space bounded at least in part by a radially-outer surface of the annular packer and a radially-inner surface of the housing to drive the annular packer in the axial direction to facilitate moving the annular blowout preventer to the closed position or maintaining the annular blowout preventer in the closed position.

18. The system of claim 17, wherein the one or more radial conduits comprise two radial conduits circumferentially spaced apart 180 degrees from one another.

19. The system of claim 17, wherein the one or more radial conduits comprise a groove formed in an axially-facing surface of the annular packer.

20. The system of claim 17, wherein the annular packer comprises rigid inserts spaced circumferentially about the annular packer, and the one or more radial conduits are disposed in the annular packer between adjacent rigid inserts.

* * * * *